US010828900B2

(12) United States Patent
Kobayashi

(10) Patent No.: US 10,828,900 B2
(45) Date of Patent: Nov. 10, 2020

(54) INKJET PRINTING DEVICE

(71) Applicant: MIMAKI ENGINEERING CO., LTD., Nagano (JP)

(72) Inventor: Hiroshi Kobayashi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/392,613

(22) Filed: Apr. 23, 2019

(65) Prior Publication Data

US 2019/0329554 A1 Oct. 31, 2019

(30) Foreign Application Priority Data

Apr. 27, 2018 (JP) ..... 2018-087847

(51) Int. Cl.
*B41J 2/165* (2006.01)
*B41J 2/175* (2006.01)

(52) U.S. Cl.
CPC ..... *B41J 2/16511* (2013.01); *B41J 2/17563* (2013.01)

(58) Field of Classification Search
CPC ..... B41J 2/16511; B41J 2/17563; B41J 2/16505; B41J 2/16526
See application file for complete search history.

(56) References Cited

U.S. PATENT DOCUMENTS

2003/0231222 A1* 12/2003 Jefferson ..... B41J 2/16511 347/29

FOREIGN PATENT DOCUMENTS

JP 2001179999 7/2001
JP 2017193159 A * 10/2017

* cited by examiner

*Primary Examiner* — Sharon Polk
(74) *Attorney, Agent, or Firm* — JCIPRNET

(57) ABSTRACT

An inkjet printing device includes: an ink head, having a nozzle hole opened in a nozzle surface; a carriage, being movable in a main scanning direction and in which multiple ink heads being arranged in the main scanning direction; and a capping mechanism. When the ink head is disposed at a standby position set within a movement range of the carriage, the capping mechanism brings the cap portion into contact with the nozzle surface to cover a region where the nozzle hole opened in the nozzle surface. The cap portion includes: an annular wall, surrounding a region where the nozzle hole opened in the nozzle surface; and a bottom wall portion, sealing an opening of the annular wall and being disposed with an interval from the nozzle surface. On an inner periphery of the annular wall, a slit directed toward the bottom wall portion is provided over the entire periphery.

9 Claims, 13 Drawing Sheets

INKJET PRINTING DEVICE

CROSS REFERENCE TO RELATED APPLICATIONS

This application claims the priority benefit of Japanese Patent Application No. 2018-087847, filed on Apr. 27, 2018. The entirety of the above-mentioned patent application is hereby incorporated by reference herein and made a part of this specification.

TECHNICAL FIELD

The present disclosure relates to an inkjet printing device.

DESCRIPTION OF THE BACKGROUND ART

In an inkjet printing device, ink in the nozzles of the inkjet head is dried and thickened during the standby state in which no image printing is performed on a printing object, and thus clogging of the nozzles sometimes occurs.

In an inkjet printing device, in order to prevent clogging of a nozzle, (a) suction removal of ink from a nozzle of an inkjet head and (b) flushing process of ejecting ink from a nozzle of an inkjet head are periodically performed.

These processes are carried out using a dedicated mechanism after moving the inkjet head to a maintenance position set on an inkjet printing device (for example, Japanese Unexamined Patent Publication No. 2001-179999).

The inkjet printing device of Japanese Unexamined Patent Publication No. 2001-179999 discloses a mechanism for preventing drying of ink in the nozzle and collecting ink mist generated at the time of the flushing process.

In the flushing process, ink mist in which the ink ejected from the nozzle is in the form of mist is generated. The ink mist easily scatters because of its very small particle diameter. When the scattered ink mist adheres to the inkjet head, the adhered ink mist becomes a mass of ink, and image defect such as missing nozzle may occur.

The mechanism disclosed in this Japanese Unexamined Patent Publication No. 2001-179999 includes a rubber cap portion. The cap portion includes a bottom portion of a rectangular shape and a wall portion that surrounds the outer circumferential edge of the bottom portion over the entire circumference, and a suction port of the ink is opened at the bottom portion.

In the mechanism disclosed in Japanese Unexamined Patent Publication No. 2001-179999, when the flushing process is performed, the cap portion is disposed at a position where the peripheral wall portion is pressed against the lower surface of the inkjet head, and a space closed with the cap portion is formed on the lower surface of the inkjet head. Then, the above processes (a) and (b) are performed on the nozzle exposed in the closed space.

Here, ink droplets may remain on the upper end of the peripheral wall portion or the like due to the surface tension of the ink in the cap portion. If the ink droplet is dried and solidified, a clearance forms when the cap portion is pressed against the lower surface of the inkjet head. Therefore, it is desired to prevent ink droplets from remaining in the cap portion.

SUMMARY

The present disclosure relates to: (1) an inkjet printing device including an ink head having a nozzle hole opened on an opposing surface facing a recording medium; and a capping mechanism that brings a cap portion made of an elastic material into contact with the opposing surface to cover a region where the nozzle hole opens in the opposing surface; where the cap portion includes an annular wall that surrounds the region where the nozzle hole opens in the opposing surface, and a slit extending in a direction of separating away from the opposing surface is provided in plurals in a peripheral direction on an inner periphery of the annular wall.

(2) The annular wall includes a vertical portion disposed in a direction along a vertical line direction when the annular wall is brought into contact with the opposing surface, and a contact portion that comes into contact with the opposing surface; the contact portion includes a tapered surface at an end side that comes into contact with the opposing surface in a direction in which an opening diameter of the annular wall increases toward the end; and in the annular wall, the slit is provided at least in a region of the tapered surface, and ink that adhered to the tapered surface is guided to the inner peripheral side of the vertical portion by the slit.

(3) Each of the slits in the annular wall extends from a position spaced apart from an end of the annular wall that comes into contact with the opposing surface.

(4) The cap portion has a bottom portion disposed with an interval from the opposing surface, and in the annular wall, a filter is disposed so as to be internally fitted to the bottom portion side relative to the tapered surface, the slit is provided at a portion of the tapered surface, and an ink discharge port is formed in the bottom portion.

(5) A nozzle row configured by arranging a plurality of the nozzle holes in a sub-scanning direction, which is a conveying direction of the recording medium, is provided on the opposing surface; a length of the bottom portion in the sub-scanning direction is longer than a length of the nozzle row in the sub-scanning direction; one side of the bottom portion in the sub-scanning direction is disposed at a position deviated from immediately below the nozzle row when the cap portion is brought into contact with the opposing surface; in the filter, a communication hole for communicating the bottom portion side and the opposing surface side sandwiching the filter is provided in a region deviated from immediately below the nozzle row; and the communication hole and the discharge port are provided so as to be shifted in position in the sub-scanning direction.

(6) A thickness of the filter in a direction orthogonal to the bottom portion becomes thicker from one side to the other side in the sub-scanning direction, and a plurality of guide grooves along the sub-scanning direction are provided on a surface of the filter on the opposing surface side.

According to the present disclosure, ink droplets can be suppressed from remaining in the cap portion.

DESCRIPTION OF EMBODIMENTS

Hereinafter, an embodiment of the present disclosure will be described using an example of an inkjet printing device (hereinafter referred to as an inkjet printing device 1) by way of example.

[Inkjet Printing Device 1]

Figure 1A:
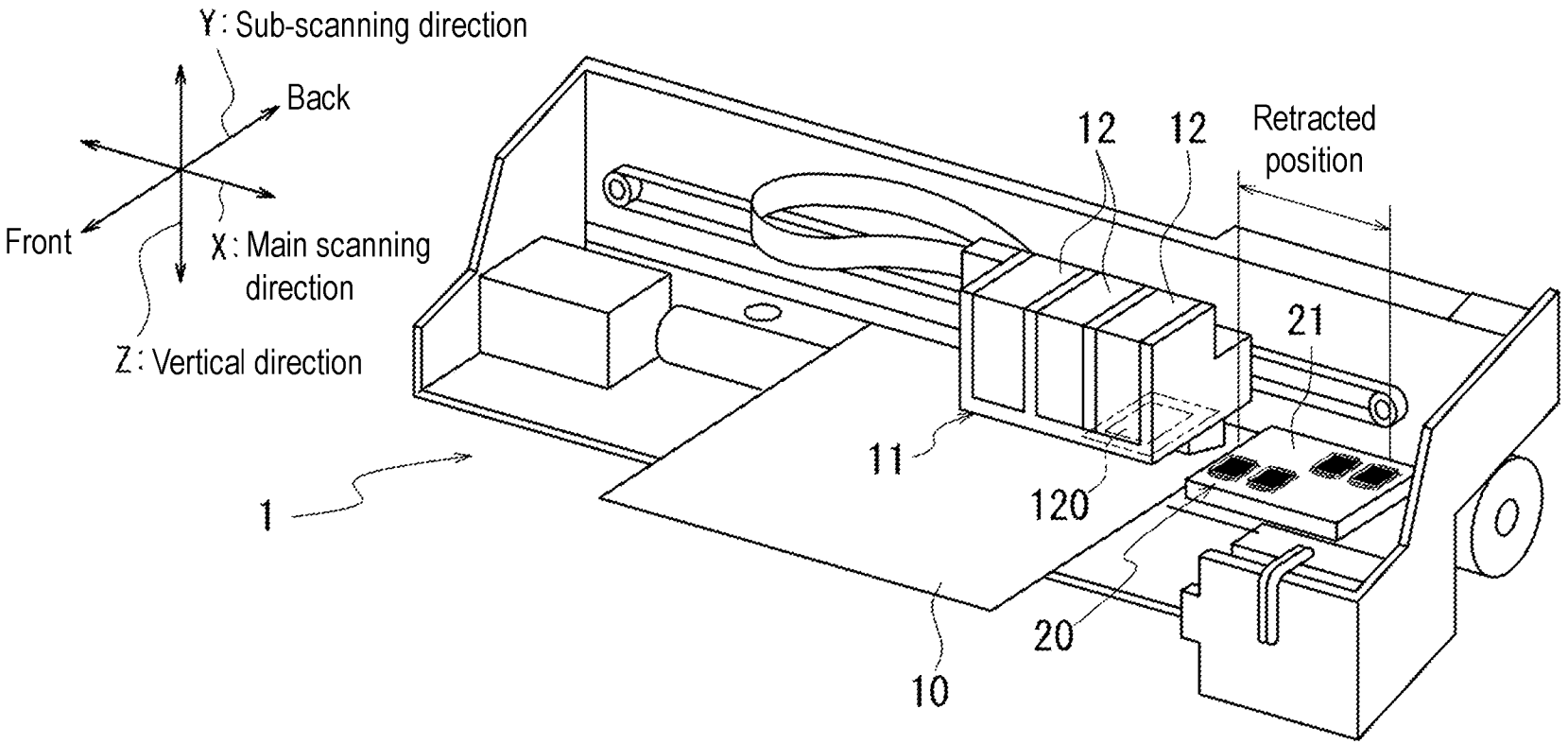
FIG. 1A to FIG. 1C are views and diagrams describing an inkjet printing device.
Figure 1C:
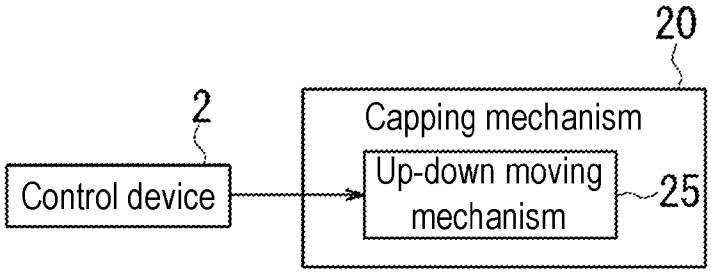
Figure 1B:
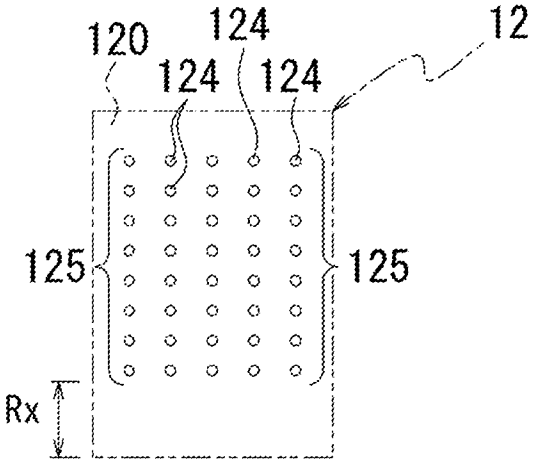

FIG. 1A to FIG. 1C are views and diagrams describing the inkjet printing device 1, where FIG. 1A is a perspective view of the inkjet printing device 1, and FIG. 1B is a schematic view describing the arrangement of nozzle holes 124 in a nozzle surface 120 of an ink head 12 (inkjet head). FIG. 1C is a function block diagram of the main part of the inkjet printing device 1. In FIG. 1B, the arrangement of the plurality of nozzle holes 124 in the nozzle surface 120 and the arrangement of a nozzle row 125 composed of the plurality of nozzle holes 124, the arrangement being when the ink head 12 is viewed from the upper side are schematically shown. In the following description, the positional relationship of each configuring elements of the inkjet printing device 1 will be described using the main scanning direction X, the sub-scanning direction Y, and the vertical direction in FIG. 1A and FIG. 1B.

The inkjet printing device 1 includes a carriage 11 on which a plurality of ink heads 12 are mounted. In the inkjet printing device 1, the carriage 11 is provided to be movable forward and backward in the main scanning direction X. The main scanning direction X is a direction orthogonal to a sub-scanning direction Y, which is the conveying direction of a recording medium 10.

In the carriage 11, the plurality of ink heads 12 are arranged in the main scanning direction X. In each ink head 12, a plurality of nozzle rows 125 are arranged on the lower surface (nozzle surface 120) facing the recording medium 10. The nozzle row 125 includes a plurality of nozzle holes 124 arranged in the sub-scanning direction Y, and the type of ink to be ejected is determined for every nozzle row 125. The nozzle rows 125 are provided parallel to each other at an interval in the main scanning direction X.

In the inkjet printing device 1, when the carriage 11 traverses above the recording medium 10 in the main scanning direction X, ink droplets are ejected from the nozzle hole 124 toward the recording medium 10. In the inkjet printing device 1, an image is formed from the landed ink droplets on the recording medium 10 by repeating movement of the carriage 11 in the main scanning direction X and movement of the recording medium 10 in the sub-scanning direction Y.

In the inkjet printing device 1, the ink pressurized by a pressure generating chamber (not shown) is ejected toward the recording medium 10 as ink droplets from the nozzle hole 124 to perform printing. Therefore, clogging may occur in the nozzle hole 124 due to increase in the ink viscosity caused by evaporation of the solvent contained in the ink, solidification of the ink, non-adhesion of dust, mixing of air bubbles, and the like. When the clogging occurs in the nozzle hole 124, a defect (print defect) occurs in the image formed on the recording medium 10.

The inkjet printing device 1 includes a capping mechanism 20 for preventing the clogging of the nozzle hole.

Figure 2:
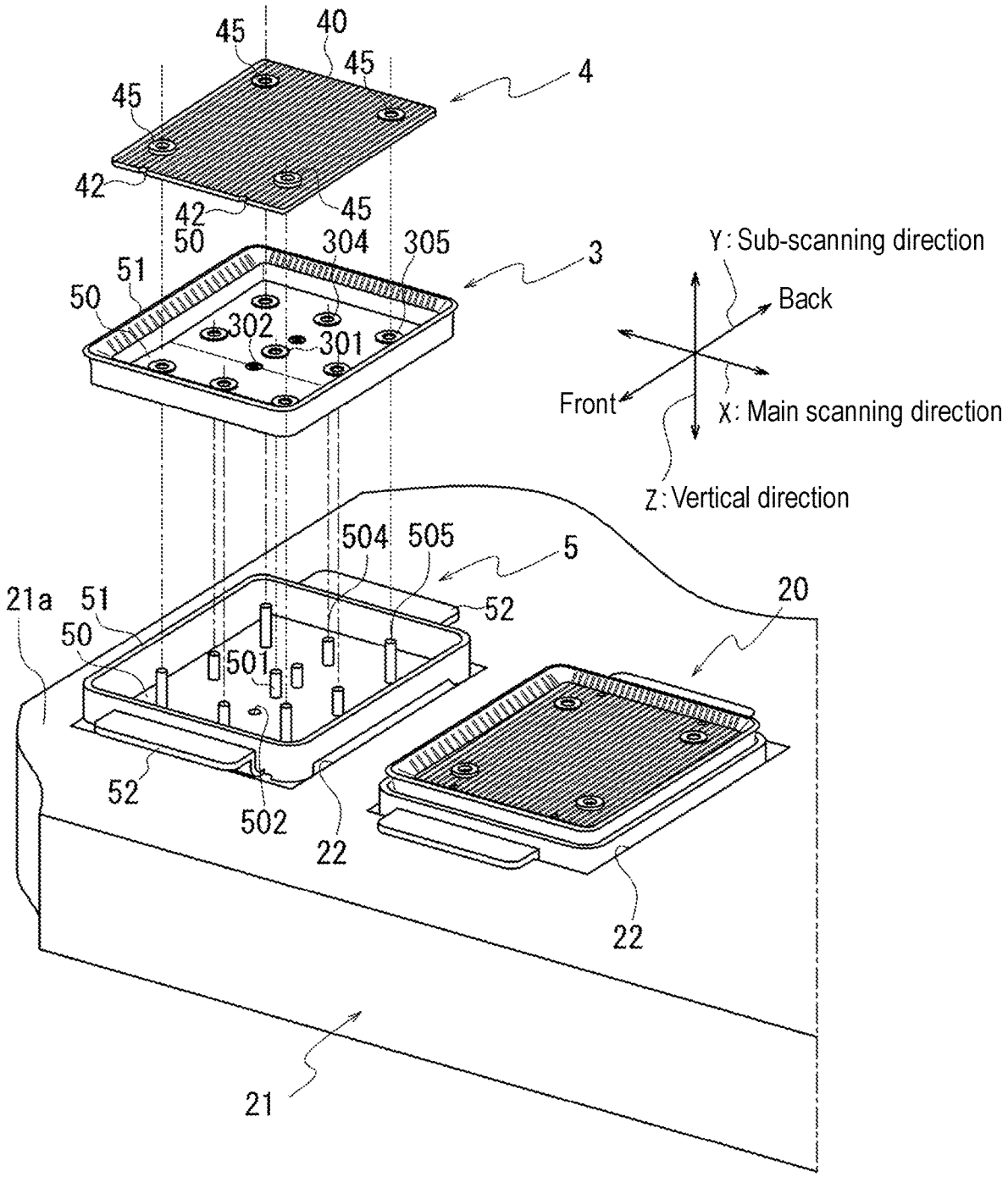
FIG. 2 is a view describing a capping mechanism.
Figure 3A:
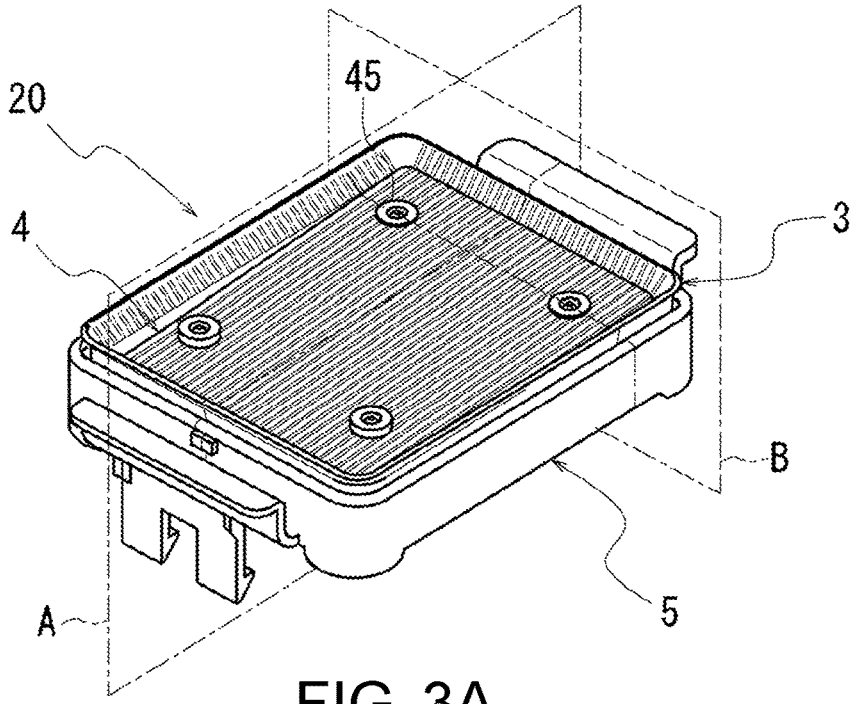
FIG. 3A to FIG. 3C are views describing the capping mechanism.
Figure 3B:
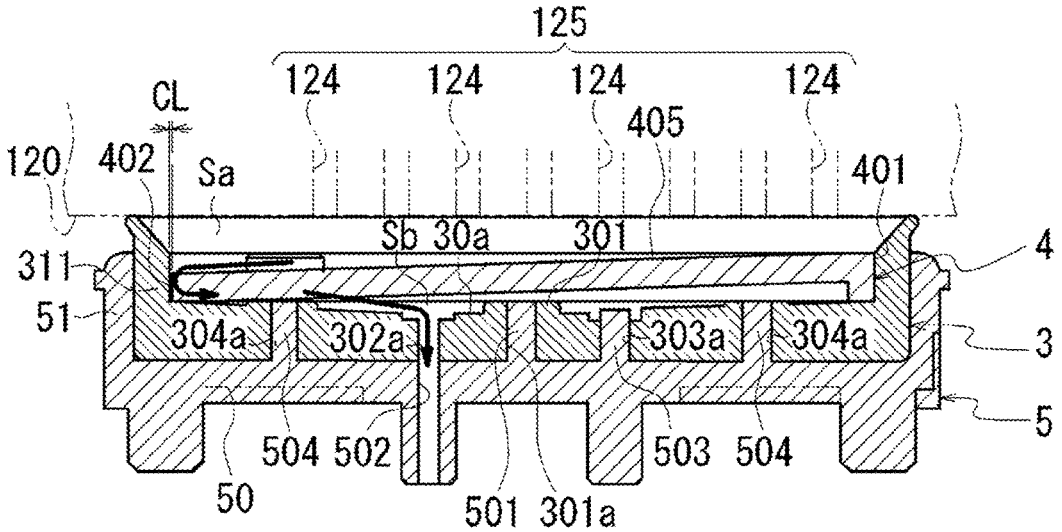
Figure 3C:
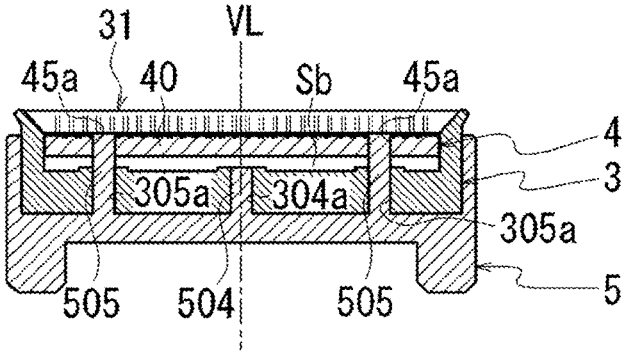

FIG. 2 is a view describing the capping mechanism 20. In FIG. 2, the constituent elements (holder 5, cap portion 3, filter 4) of one of the capping mechanisms 20 arranged in the main scanning direction X are shown separated from each other. FIG. 3A to FIG. 3C are views describing the main part of the capping mechanism 20. FIG. 3A is a perspective view of the capping mechanism 20. FIG. 3B is a cross-sectional view of the main part of the capping mechanism 20 taken along a plane A in FIG. 3A. FIG. 3C is a cross-sectional view of the main part of the capping mechanism 20 taken along a plane B in FIG. 3A.

As shown in FIG. 2, the capping mechanism 20 includes a holder 5, a cap portion 3, and a filter 4. The filter 4 is provided to be fitted in the cap portion 3, and the cap portion 3 is provided to be fitted in the holder 5. In the inkjet printing device 1, a dedicated capping mechanism 20 is prepared for each ink head 12.

The capping mechanism 20 is configured so that the cap portion 3 made of an elastic material is brought into contact with the nozzle surface 120 of the ink head 12 and the cap portion 3 covers a region where the nozzle hole 124 opens in the nozzle surface 120. Here, the cap portion 3 is formed using, for example, butyl rubber, ethylene propylene diene rubber (EPDM), or the like in order to ensure adhesion with the ink head 12 (nozzle surface 120) during the cleaning operation.

In the capping mechanism 20, (a) the cap portion 3 is caused to function as a lid for preventing drying of the ink in the nozzle hole 124 by covering the region where the nozzle hole 124 opens in the nozzle surface 120 with the cap portion 3.

Furthermore, when clogging occurs in the nozzle hole 124, the capping mechanism 20 generates a negative pressure in a space Sa formed between the cap portion 3 and the nozzle surface 120, and (b) the cap portion 3 is caused to function as an attachment for suctioning and removing foreign substances in the nozzle hole 124.

In the inkjet printing device 1, when clogging occurs in the nozzle hole 124, the cleaning operation for forcibly discharging the ink from the nozzle hole 124 is performed. The cleaning operation is executed in the inkjet printing device 1 when printing is resumed after a long pause or when the user operates a cleaning switch on an operation panel.

In the cleaning operation, the ink is forcibly discharged from the nozzle hole 124 in order to eliminate the clogging that occurred in the nozzle hole 124. Moreover, after ink and foreign substances in the nozzle hole 124 are forcibly discharged from the nozzle hole 124 by the negative pressure generated between the nozzle surface 120 and the cap portion 3, the surface of the nozzle surface 120 is wiped with a cleaning member (not shown) made of an elastic material.

In the inkjet printing device 1, a flushing operation for periodically ejecting ink from the nozzle hole 124 is performed in order to prevent clogging in the nozzle hole 124. In the inkjet printing device 1, the cleaning operation and the flushing operation are performed in a state where the cap portion 3 is pressed against the nozzle surface 120.

When performing the cleaning operation or the flushing operation, the carriage 11 is moved to a retracted position (see FIG. 1A) set on a conveyance path of the carriage 11. In the case of FIG. 1A, the retracted position is set at a position separated away toward the right side in the main scanning direction X from the printing medium 10, which is the printing object.

Each of the capping mechanisms 20 is provided at a position to be immediately below the corresponding ink head 12, when the carriage 11 is disposed at the retracted position above a support table 21 (see FIG. 1A).

Hereinafter, the constituent elements (holder 5, cap portion 3, filter 4) of the capping mechanism 20 will be described.

The support table 21 is provided below the retracted position of the carriage 11, and a rectangular opening 22 (see FIG. 2) is provided on the upper surface of the support table 21. The opening 22 is opened at a position to be immediately below the corresponding ink head 12, and the holder 5 supported by an up-down moving mechanism (not shown) is disposed in each of the openings 22.

[Holder 5]

Figure 4A:
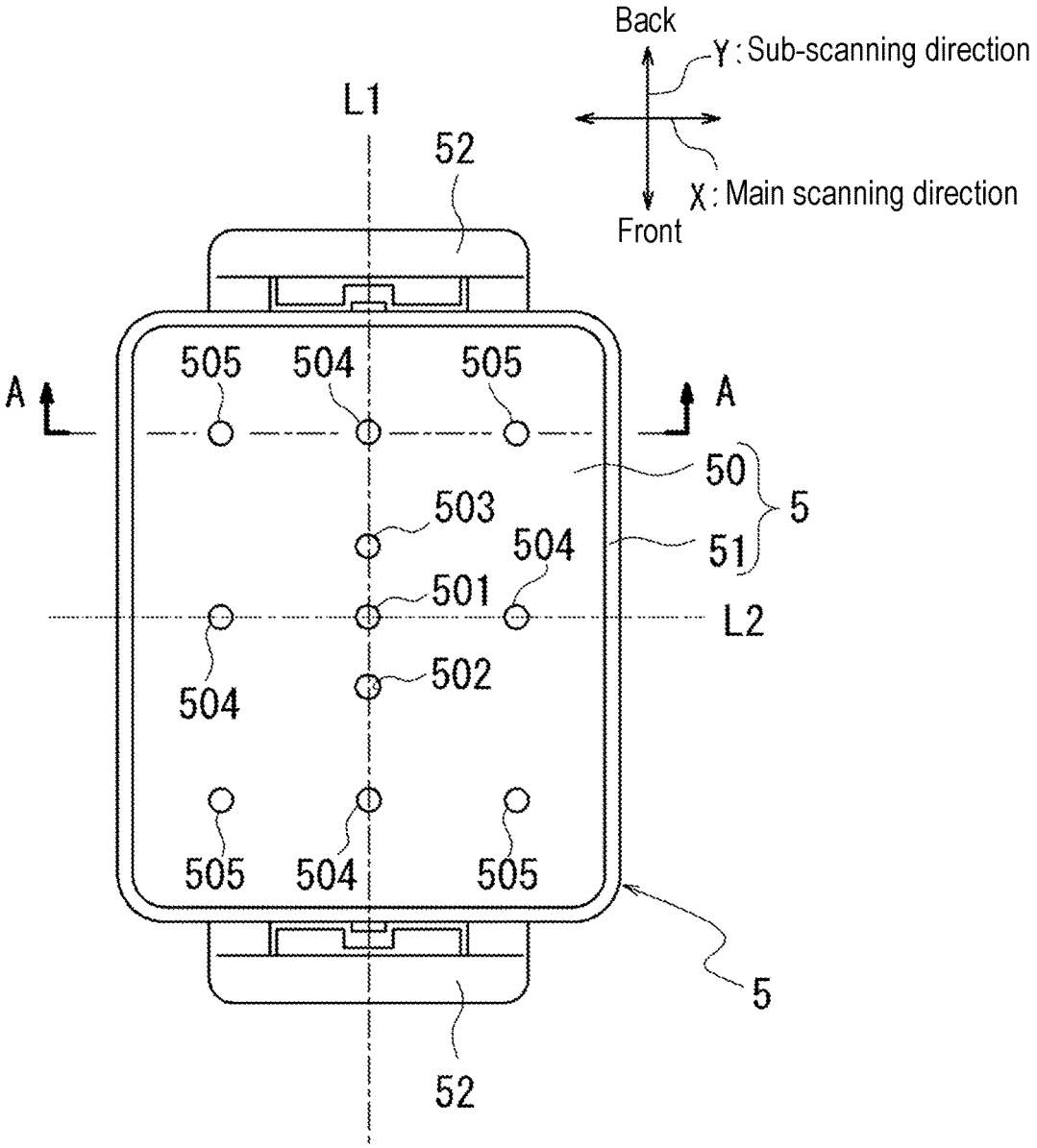
FIG. 4A and FIG. 4B are views describing a holder of the capping mechanism.
Figure 4B:
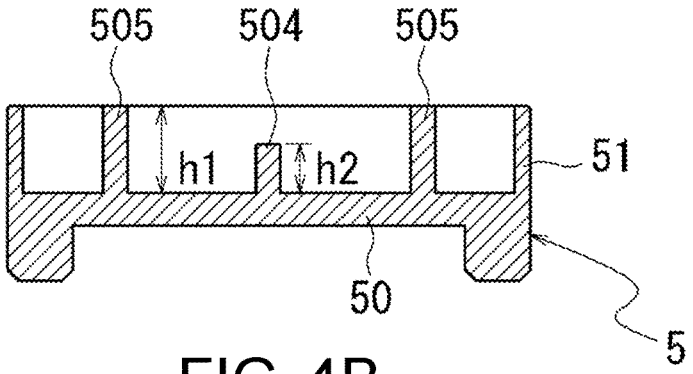

FIG. 4A and FIG. 4B are views describing the holder 5 of the capping mechanism 20. FIG. 4A is a view of the holder 5 as viewed from above, and FIG. 4B is a cross-sectional view taken along the line A-A in FIG. 4A.

As shown in FIG. 4A and FIG. 4B, the holder 5 is a bottomed box-shaped member and is formed with an outer shape slightly smaller than the opening 22 (see FIG. 2). The holder 5 is provided with the opening facing upward, and a peripheral wall portion 51 surrounding a bottom wall portion 50 is provided with locking portions 52 and 52 on both sides in a longitudinal direction (sub-scanning direction Y).

The locking portions 52 and 52 are extended in a direction of separating away from the peripheral wall portion 51 from one side and the other side of the peripheral wall portion 51 in the sub-scanning direction Y. The locking portions 52 and 52 are located on a straight line L1 along the sub-scanning direction Y, and are provided in such a positional relationship that they are symmetrical with respect to a straight line L2 along the main scanning direction X.

As shown in FIG. 2, the holder 5 is disposed at an accommodated position where the locking portions 52 and 52 are locked to the upper surface 21*a* of the support table 21 in a standby state in which the cleaning operation and the flushing operation are not performed, or a state in which the nozzle hole 124 opened in the nozzle surface 120 is not protected.

As shown in FIG. 4A, a centering protrusion 501 having a circular column shape is provided at the central portion of the bottom wall portion 50. The centering protrusion 501 is positioned at the intersection of the straight lines L1 and L2 orthogonal to each other and is used for the centering of the cap portion 3, to be described later. Here, the straight line L1 is a straight line passing through the center of the bottom wall portion 50 in the main scanning direction X, and the straight line L2 is a straight line passing through the center of the bottom wall portion 50 in the sub-scanning direction Y.

Protrusions 504 and 504 are provided on both sides of the centering protrusion 501 in the sub-scanning direction Y and on both sides of the protrusion in the main scanning direction X on the bottom wall portion 50. The protrusions 504 and 504 located on the straight line L1 are provided in such a positional relationship that they are symmetrical with respect to the straight line L2. The protrusions 504 and 504 positioned on the straight line L2 are provided in such a positional relationship that they are symmetrical with respect to the straight line L1.

In the bottom wall portion 50, protrusions 505, 505, 505, and 505 having a circular column shape are provided on one side (left side in FIG. 4A) and the other side (right side in FIG. 4A) sandwiching the straight line L1. The protrusions 505 and 505 on one side (left side in FIG. 4A) sandwiching the straight line L1 are provided in such a positional relationship that they are symmetrical with respect to the straight line L2. The protrusions 505 and 505 on the other side (right side in FIG. 4A) sandwiching the straight line L1 are provided in such a positional relationship that they are symmetrical with respect to the straight line L2.

The protrusions 505 are protrusions used for positioning of the filter 4, to be described later, in addition to the positioning of the cap portion 3, to be described later, where the height h1 from the bottom wall portion 50 is higher than the height h2 of the protrusion 504 (h1>h2), as shown in FIG. 4B.

Furthermore, in the bottom wall portion 50, a discharge port 502 and a protrusion 503 are provided on both sides of the centering protrusion 501 in the sub-scanning direction Y. As shown in FIG. 3B, the discharge port 502 passes through the bottom wall portion 50 in the thickness direction (vertical direction), and the discharge port 502 is communicated to a discharge pipe (not shown) attached with a pump.

As shown in FIG. 4A, the protrusion 503 is a circular column shaped member projecting out toward the near side in the plane of drawing, and the protrusion 503 and the discharge port 502 are provided in such a positional relationship that they are symmetrical with respect to the straight line L2.

As shown in FIG. 3B, in the holder 5, the cap portion 3 is accommodated on the inner side of the peripheral wall portion 51.

[Cap Portion 3]

Figure 5A:
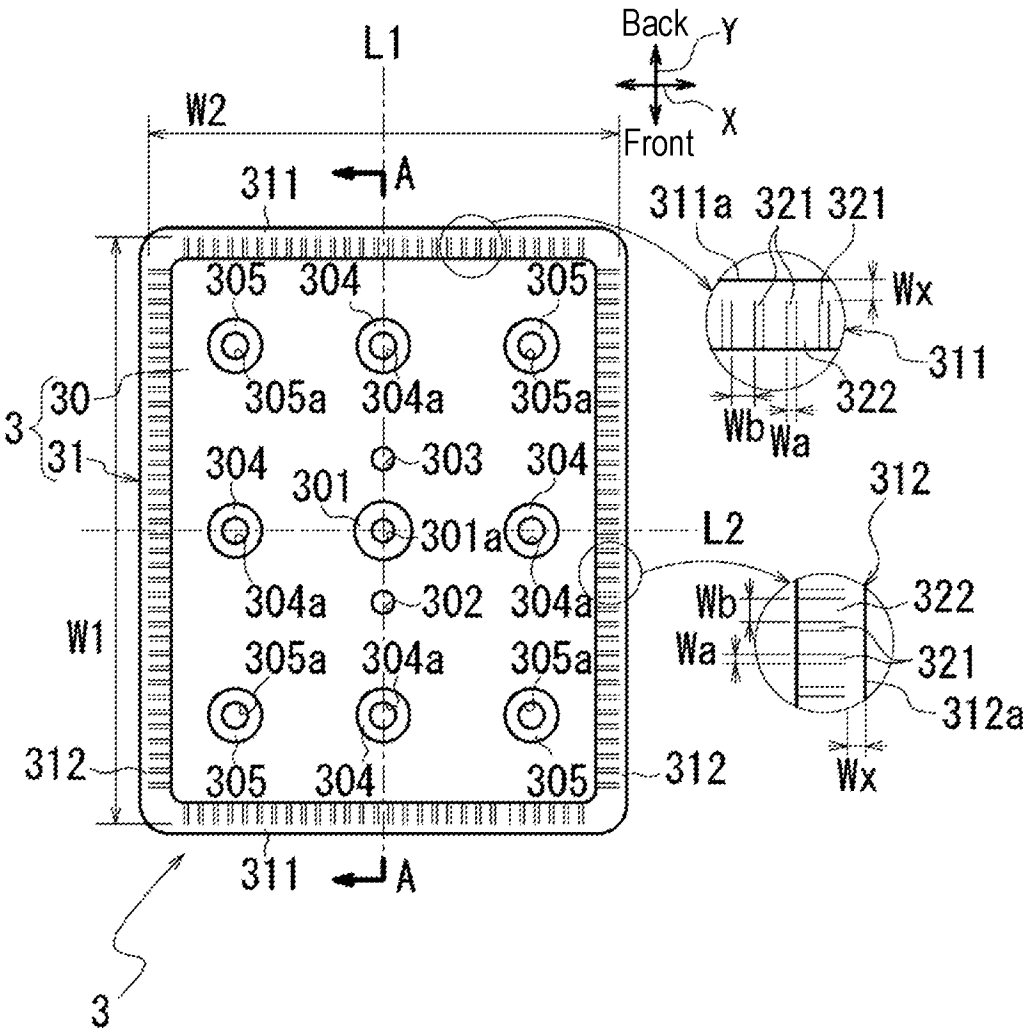
FIG. 5A to FIG. 5C are views describing a cap portion of the capping mechanism.
Figure 5B:
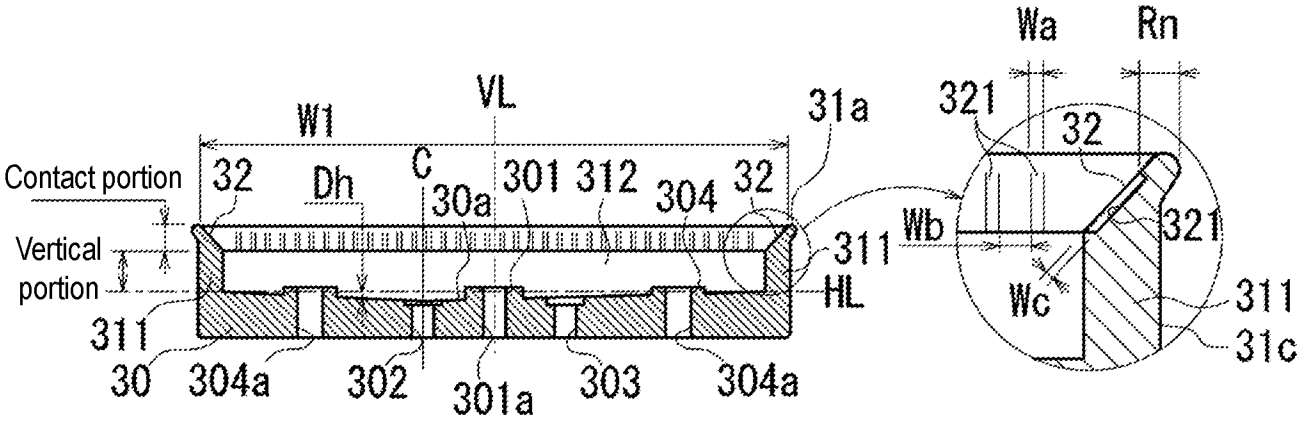
Figure 5C:
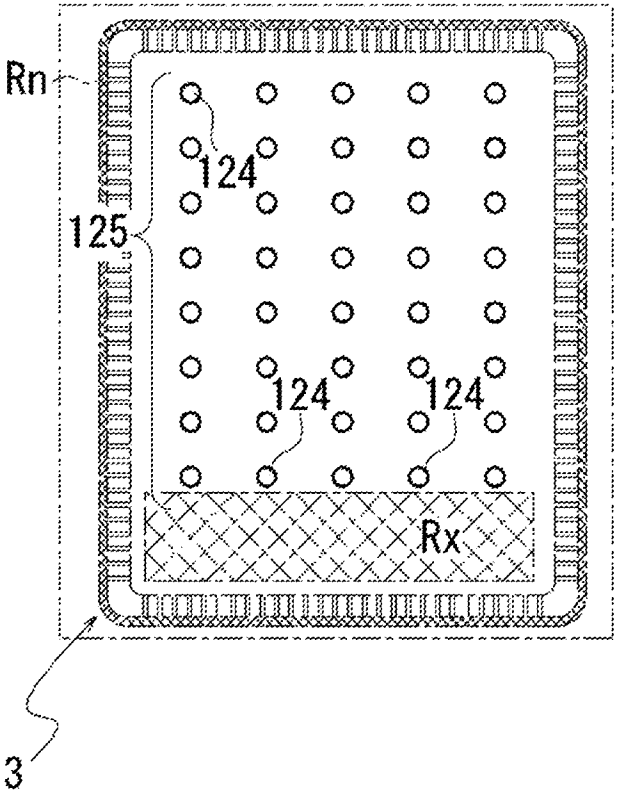

FIG. 5A to FIG. 5C are views describing the cap portion 3 of the capping mechanism 20. FIG. 5A is a view of the cap portion 3 viewed from above, FIG. 5B is a cross-sectional view taken along line A-A in FIG. 5A, and FIG. 5C is a view describing a positional relationship between the cap portion 3 and the nozzle row 125 in a state where the carriage 11 (see FIG. 1A) is disposed at the retracted position.

As shown in FIG. 5A and FIG. 5B, the cap portion 3 is a bottomed box-shaped member and is formed in an outer shape that can be accommodated on the inner side of the peripheral wall portion 51 of the holder 5. The cap portion 3 is provided with the opening facing upward, and an annular wall 31 surrounding the bottom wall portion 30 includes a pair of short side parts 311 and 311 along the main scanning direction X and a pair of long side parts 312 and 312 along the sub-scanning direction Y. The short side parts 311 and 311 connect the ends of the long side parts 312 and 312 to each other. The annular wall 31 is formed to an annular shape having a substantially rectangular shape from the short side parts 311 and 311 and the long side parts 312 and 312, and the peripheral wall portion 51 is extended over the entire periphery of the bottom wall portion 30.

A tubular centering boss portion 301 having a through hole 301*a* is provided at a central portion of the bottom wall portion 30. The centering boss portion 301 is located at the intersection of the straight lines L1 and L2 orthogonal to each other, so that the centering protrusion 501 on the holder 5 side is fitted into the through-hole 301*a* when the cap portion 3 is assembled to the holder 5 (see FIG. 3B).

As shown in FIG. 3B, the centering boss portion 301 projects slightly upward from the upper surface 30*a* of the bottom wall portion 30. The centering boss portion 301 is in contact with the lower surface of the filter 4, and a space Sb is formed between the filter 4 and the bottom wall portion 30.

As shown in FIG. 5A, in the bottom wall portion 30, tubular boss portions 304 and 304 having through holes 304*a* and 304*a* are provided on both sides of the centering boss portion 301 in the sub-scanning direction Y and on both sides of the centering boss portion 301 in the main scanning direction X. The boss portions 304 and 304 located on the straight line L1 are provided in such a positional relationship that they are symmetrical with respect to the straight line L2. The boss portions 304 and 304 located on the straight line L2 are provided in such a positional relationship that they are symmetrical with respect to the straight line L1.

These boss portions 304, 304, 304, and 304 are provided at positions corresponding to the protrusions 504, 504, 504, and 504 (see FIG. 4A) on the holder 5 side. When the cap portion 3 is assembled to the holder 5, the protrusion 504 on the holder 5 side fits into the through hole 304*a* of the boss portion 304 (see FIG. 3B and FIG. 3C). In this state, the height h2 (see FIG. 4B) of the protrusion 504 is set to a height that does not project upward from the boss portion 304.

Furthermore, in the bottom wall portion 30, a discharge hole 302 and the through hole 303 are provided on both sides of the centering boss portion 301 in the sub-scanning direction Y. As shown in FIG. 5B, the discharge hole 302 and the through hole 303 pass through the bottom wall portion 30 in the thickness direction (vertical direction), and the discharge hole 302 and the through hole 303 are provided at positions corresponding to the discharge port 502 and the protrusion 503 on the holder 5 side, respectively.

When the cap portion 3 is assembled to the holder 5, the protrusion 503 on the holder 5 side is fitted into the discharge port 502 (see FIG. 3B). In this state, the discharge hole 302 is communicated to a discharge pipe (not shown) attached with a pump by way of the discharge port 502 on the holder 5 side.

As shown in FIG. 5B, in the sub-scanning direction Y, the bottom wall portion 30 has an inclination angle of one side (left side in the drawing) and the other side (right side in the figure) in the sub-scanning direction Y reversed with the position of the discharge hole 302 as a boundary. At the upper surface 30*a* of the bottom wall portion 30, the separated distance (depth Dh) from the horizontal line HL with respect to the intersection of the bottom wall portion 30 and the short side part 311 is different in the sub-scanning direction Y, and the portion of the discharge hole 302 is the deepest. The depth Dh becomes shallower as it approaches the short side part 311 and 311 away from the discharge hole 302 in the sub-scanning direction Y. This is so that the ink that adhered to the upper surface 30*a* of the bottom wall portion 30 can move toward the discharge hole 302 by its own weight.

As shown in FIG. 5A, in the bottom wall portion 30, tubular boss portions 305, 305, 305, and 305 having a through hole 305*a* are provided on one side (left side in FIG. 5A) and the other side (right side in FIG. 5A) sandwiching the straight line L1 The boss portions 305 and 305 on one side (left side in FIG. 5A) sandwiching the straight line L1 are provided in such a positional relationship that they are symmetrical with respect to the straight line L2. The boss portions 305, 305 on the other side (right side in FIG. 5A) sandwiching the straight line L1 are provided in such a positional relationship that they are symmetrical with respect to the straight line L2.

When the cap portion 3 is assembled to the holder 5, the protrusion 505 on the holder 5 side passes through the through hole 305*a* of the boss portion 305 and projects upward from the boss portion 305 (see FIG. 3C).

As shown in FIG. 5A and FIG. 5B, in the annular wall 31, a tapered surface 32 is provided on the inner periphery of the upper end 31*a* side. The tapered surface 32 is inclined in such a direction that the opening diameters W1 and W2 of the space surrounded by the annular wall 31 become wider toward the upper end 31*a*. The tapered surface 32 is provided to reduce the thickness of the upper end 31*a* of the annular wall 31 so that ink droplets are less likely to remain at the upper end 31*a*.

In the cross-sectional view, the upper end 31*a* of the annular wall 31 is located on the outer side of the outer periphery 31*c* (see FIG. 5B, enlarged view) of the annular wall 31 (short side part 311, long side part 312).

The inner periphery of the annular wall 31 (short side part 311, long side part 312) has a region on the bottom wall portion 30 side relative the tapered surface 32 serving as a supporting wall part having an inner diameter that matches the outer shape of the filter 4 to be described later. As shown in FIG. 5B, in the annular wall 31, a region where the tapered surface 32 is provided in the vertical line VL is a contacting portion with the nozzle surface 120, and a region on the bottom wall portion 30 side viewed from such a contacting portion (region where tapered surface 32 is provided) is a vertical portion disposed in a direction along the vertical line VL direction when the annular wall 31 is brought into contact with the nozzle surface 120 (opposing surface).

The tapered surface 32 is provided on both the short side part 311 and the long side part 312. The tapered surface 32 is provided over the entire periphery of the annular wall 31 in the peripheral direction. A slit 321 directed toward the bottom wall portion 30 side is provided in the tapered surface 32. The slit 321 is provided in both the short side part 311 and the long side part 312. The slit 321 of the short side part 311 and the slit 321 of the long side part 312 are formed to have the same width Wa. The slit 321 of the short side part 311 and the slit 321 of the long side part 312 are provided at the same interval Wb.

In the present embodiment, the width Wa and the depth We of the slit 321, and the interval Wb of the slits 321 are formed with an optimum width and interval to exhibit the lotus effect. The optimum values of the width Wa, the interval Wb, and the depth We vary depending on the composition of the ink used in the inkjet printing device 1. This is because the surface tension of the ink and the like change according to the composition of the ink.

As an example, in the present embodiment, the width Wa is 0.1 mm to 0.3 mm, the depth is 0.03 mm to 0.04 mm, and the interval Wb is 0.8 mm to 1.0 mm.

When set to an optimum value to exhibit the lotus effect, the wettability of the ink that adhered to the tapered surface 32 and the ink mist with respect to the tapered surface 32 becomes low, and droplets form. That is, the ink and ink mist that adhered to the tapered surface 32 are in line contact with the tapered surface 32, the contact angle between the ink and the tapered surface 32 becomes large, and hence the water repellency of the tapered surface 32 improves.

As a result, the droplets formed on the tapered surface 32 do not stay on the tapered surface 32 but move toward the lower side on the bottom wall portion 30 side along the tapered surface 32. Here, the slits 321 arranged at a predetermined interval are exemplified as the shape for improving the water repellency, but for example, the water repellency can be improved by providing a satin pattern on the tapered surface 32.

When the wettability of the tapered surface 32 is low, the ink that adhered to the annular wall 31 may sometimes solidify as is. When the solidification of the ink occurs in the vicinity of the upper end 31*a* of the annular wall 31, the annular wall 31 of the cap portion 3 is elastically pressure contacted to the nozzle surface 120 without a clearance, and thus a closed space cannot be formed between the cap portion 3 and the nozzle surface 120.

As described above, occurrence of a situation in which a closed space cannot be formed between the cap portion 3 and the nozzle surface 120 can be suitably prevented by providing the fine slits 321 exhibiting the lotus effect on the tapered surface 32.

In the present embodiment, the slit 321 of the short side part 311 and the slit 321 of the long side part 312 each extend from a position spaced apart by a predetermined width Wx (e.g., 0.5 mm) from the end 311*a* on the outer peripheral side (see FIG. 5A, enlarged view) toward the inner peripheral side of the annular wall 31 toward the bottom wall portion 30 side.

Therefore, an annular region Rn (see FIG. 5C, crossed hatched region) having a predetermined width Wx is formed on the upper end 31*a* side of the annular wall 31, where when the cap portion 3 is brought into contact with the nozzle surface 120 of the ink head 12, the annular wall 31 of the cap portion 3 is brought into elastic contact with the nozzle surface 120 without a clearance so that a closed space is formed between the cap portion 3 and the nozzle surface 120.

In the present embodiment, the capping mechanism 20 is positioned so that all the target nozzle rows 125 are accommodated on the inner side of the annular wall 31 with the annular wall 31 of the cap portion 3 brought into pressure contact with the nozzle surface 120. Furthermore, on the inner side of the annular wall 31, the capping mechanism 20 is positioned such that a blank region Rx without the nozzle hole 124 is ensured on one side in the sub-scanning direction Y in each nozzle row 125.

[Filter 4]

Figure 6A:
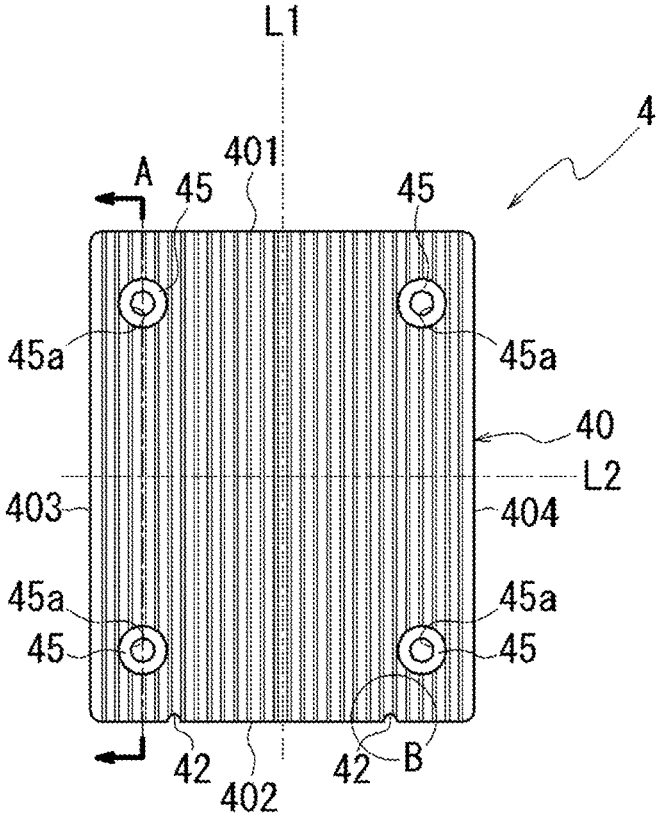
FIG. 6A to FIG. 6D are views describing a filter of the capping mechanism.
Figure 6B:
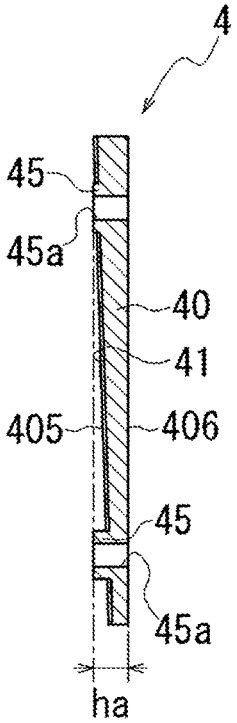
Figure 6C:
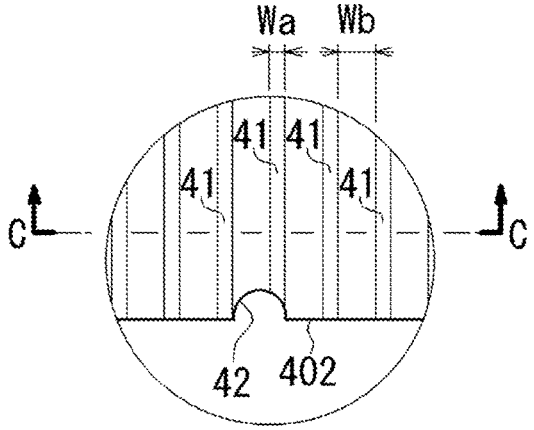
Figure 6D:
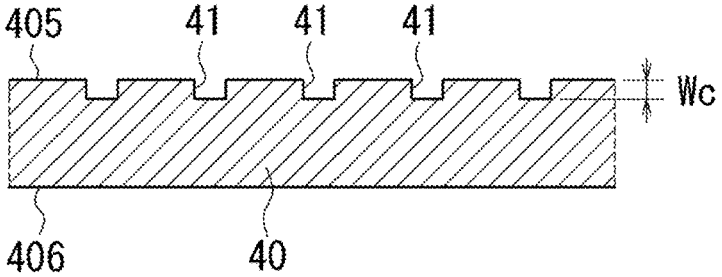

As shown in FIG. 3B, in the cap portion 3, the filter 4 is internally fitted to the inner side of the annular wall 31. FIG. 6A to FIG. 6D are views describing the filter 4 of the capping mechanism 20. FIG. 6A is a view of the filter 4 as viewed from above, and FIG. 6B is a cross-sectional view taken along the line A-A in FIG. 6A. FIG. 6C is an enlarged view of region B in FIG. 6A, and FIG. 6D is a cross-sectional view taken along line C-C in FIG. 6C.

As shown in FIG. 6A, the filter 4 has a plate-shaped base portion 40. In plan view, the base portion 40 has a rectangular shape, and has short side parts 401 and 402 parallel to each other and long side parts 403 and 404 parallel to each other.

The base portion 40 is formed in an outer shape that can be accommodated on the inner side of the annular wall 31. A through hole 45*a* for positioning is provided in the base portion 40, and a tubular boss portion 45 surrounding the through hole 45*a* is provided so as to project upward on the upper surface 405 of the base portion 40.

In the base portion 40, two boss portions 45 are respectively provided on one side (upper side in FIG. 6A) and the other side (lower side in FIG. 6A) along the direction of the straight line L1 along the main scanning direction X.

The boss portions 45 and 45 on one side in the straight line L1 direction and the boss portions 45 and 45 on the other side are provided in such a positional relationship that they are symmetrical with respect to the straight line L2 orthogonal to the straight line L1 and are respectively provided at positions closer to the short side parts 401 and 402.

These boss portions 45, 45, 45, and 45 are provided at positions corresponding to the protrusions 505, 505, 505, and 505 (see FIG. 4A) on the holder 5 side. When the filter 4 is assembled to the holder 5 together with the cap portion 3, the protrusion 505 on the holder 5 side passed through the through hole 305*a* of the cap portion 3 is fitted into the through hole 45*a* of the boss portion 45 (see FIG. 3C).

In this state, the height h1 (see FIG. 4B) of the protrusion 505 is set to a height that fits within the annular wall 31 of the cap portion 3.

When the filter 4 is disposed on the inner side of the annular wall 31, the mutually parallel short side parts 401 of the base portion 40 contact the short side part 311 of the annular wall 31, and the long side parts 403 and 404 of the base portion 40 contact the long side parts 312 and 312 of the annular wall 31.

The short side part 402 of the base portion 40 is disposed with a slight clearance CL between the short side part 402 and the short side part 311 (see FIG. 3B).

As shown in FIG. 6A and FIG. 6C, in the short side part 402 of the base portion 40, the communication holes 42 and 42 are provided in such a positional relationship that they are symmetrical with respect to the straight line L1. The communication holes 42 and 42 are cutout portions formed by cutting out the short side part 402 to a semicircular shape, and the communication holes 42 and 42 are provided with the opening facing outward. The communication holes 42 and 42 pass through the base portion 40 in the thickness direction, and a space on one side (upper side) in the thickness direction of the filter 4 and a space on the other side (lower side) are communicated via the communication holes 42 and 42.

As shown in FIG. 6B, the upper surface 405 of the base portion 40 is inclined in a direction in which the separated distance ha from the lower surface 406 becomes smaller from the short side part 401 on one side to the short side part 402 on the other side in the longitudinal direction. Therefore, in a state where the filter 4 is assembled to the cap portion 3, the upper surface 405 of the base portion 40 of the filter 4 is inclined in a direction in which the height decreases from the short side part 401 on one side to the short side part 402 on the other side.

As shown in FIG. 6A, a guide groove 41 linearly extending along the longitudinal direction of the base portion 40 is formed on the upper surface of the base portion 40. The guide groove 41 is provided from the short side part 401 located on one side in the longitudinal direction of the base portion 40 to the short side part 402 located on the other side.

The guide groove 41 is formed with the same width Wa as the above-described slit 321, and the adjacent guide grooves 41 and 41 are provided at the same interval Wb as the above-described slits 321. The guide groove 41 is also formed with the width Wa, the interval Wb, and the depth We that exhibit the lotus effect described above. Therefore, ink droplets that moved along the slits 321 of the cap portion 3 and guided to the upper surface 405 of the filter 4 also have low wettability with respect to the upper surface 405 of the base portion 40.

As described above, the upper surface 405 of the base portion 40 of the filter 4 is inclined in a direction in which the height decreases from the short side part 401 on one side to the short side part 402 on the other side. Therefore, the ink droplet guided to the upper surface 405 of the filter 4 moves toward the short side part 402 on the other side of the base portion 40. The ink droplets move toward the bottom wall portion 30 side of the cap portion 3 through the clearance CL (see FIG. 3B) between the communication holes 42 and 42 provided in the short side part 402 and the short side part 311 of the cap portion 3.

Figure 7A:
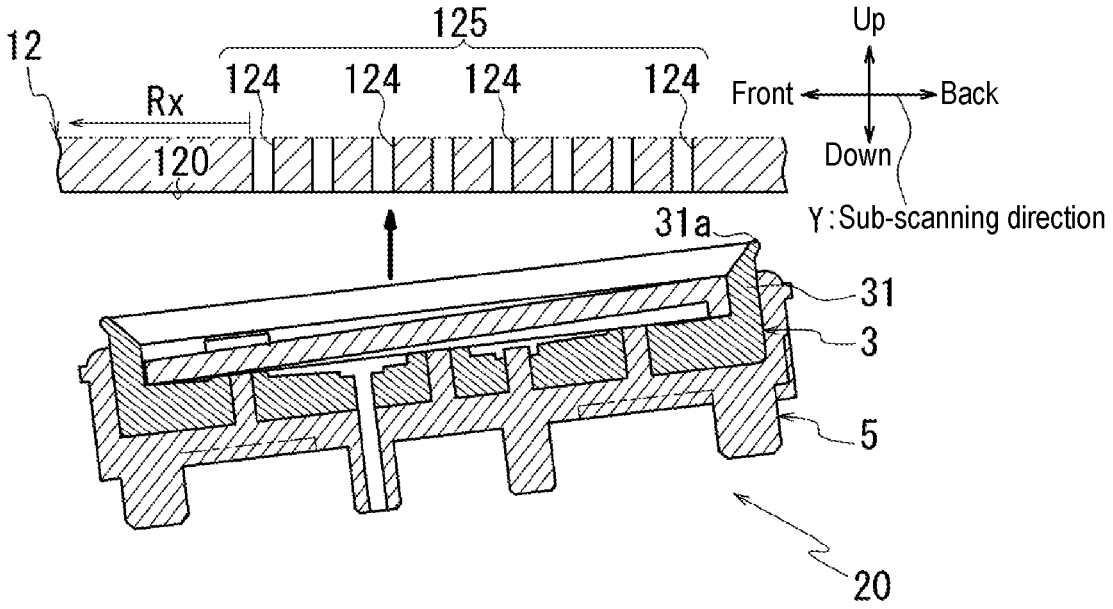
FIG. 7A to FIG. 7C are views describing the operation of the capping mechanism.
Figure 7B:
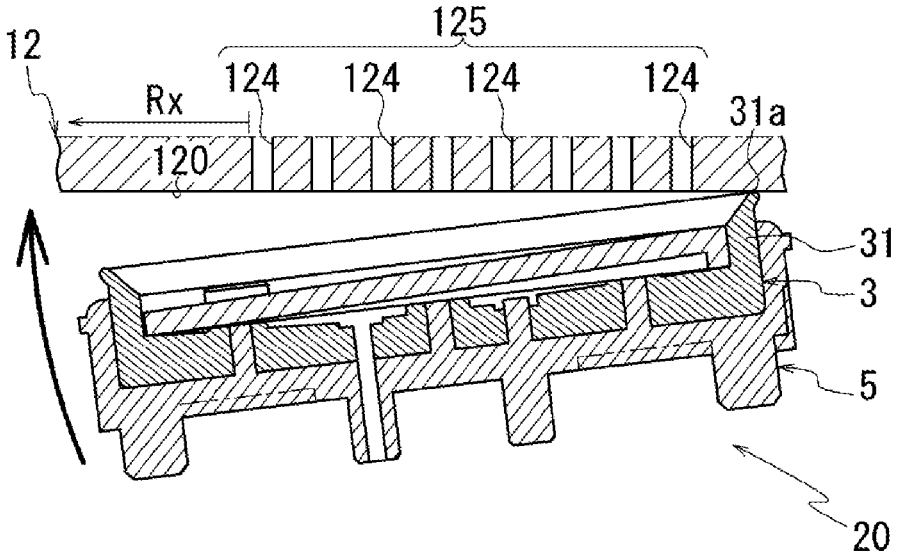
Figure 7C:
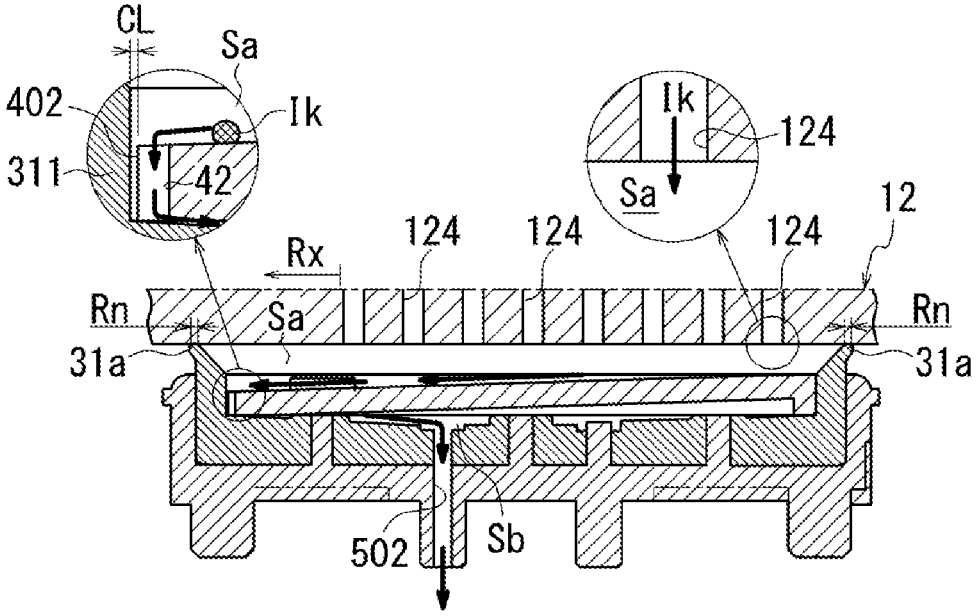
Figure 8A:
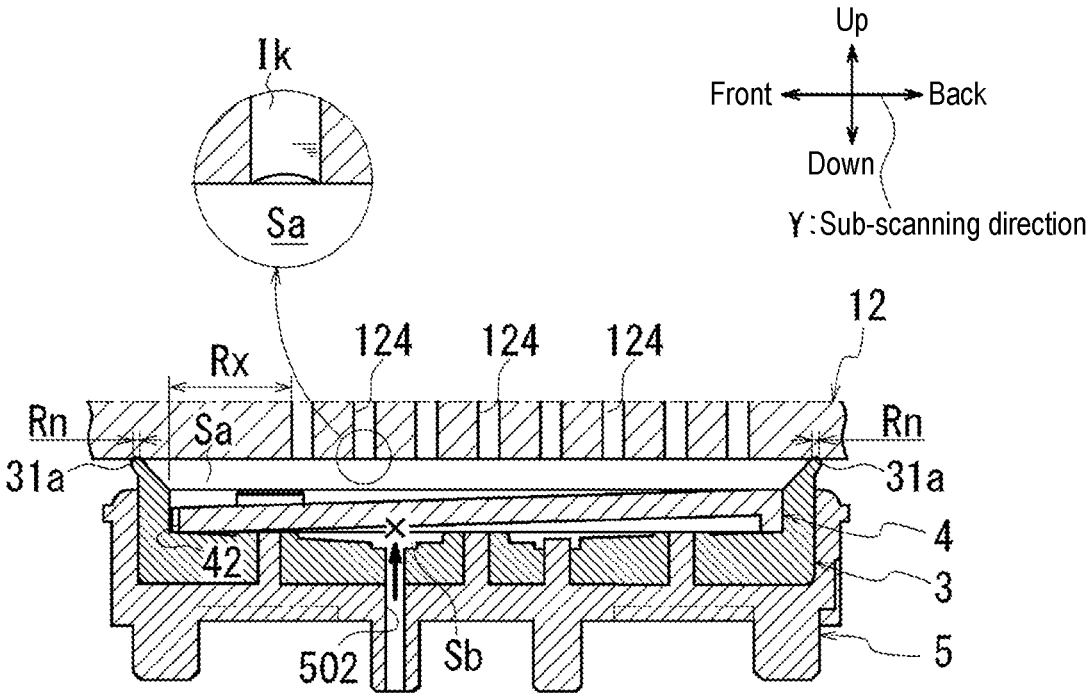
FIG. 8A to FIG. 8C are views describing the operation of the capping mechanism.
Figure 8B:
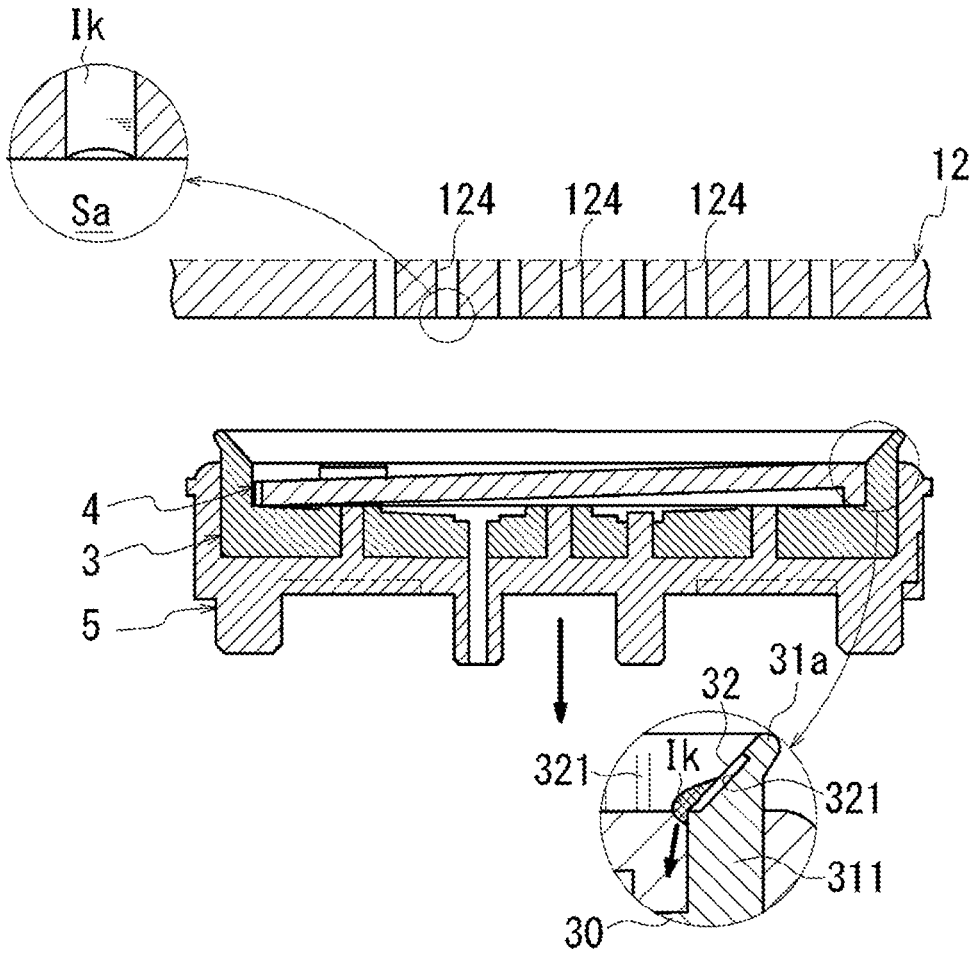
Figure 8C:
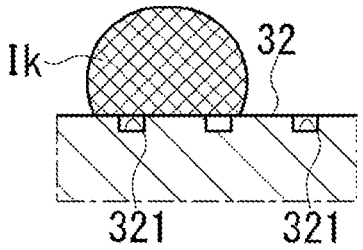

The operation of the capping mechanism 20 provided in the inkjet printing device 1 will be described. FIG. 7A to FIG. 7C and FIG. 8A to FIG. 8C are views describing the operation of the capping mechanism 20. FIG. 7A is a view showing a state in which the holder 5 is being raised toward the carriage 11 disposed at the retracted position. FIG. 7B is a view describing a state in which the inclination of the holder 5 is changed. FIG. 7C is a view showing a state in which the flushing operation is being performed after covering the nozzle hole 124 exposed to the nozzle surface 120 with the cap portion 3. FIG. 8A is a view describing the effect of the filter 4 when the ink is flowed backward from the discharge port 502 in a state where the nozzle hole 124 exposed to the nozzle surface 120 is covered with the cap portion 3. FIG. 8B is a view showing a state in which the cap portion 3 is separated toward the lower side from the nozzle surface 120. FIG. 8C is a view describing the effect (lotus effect) of the slit 321 on the tapered surface 32 of the cap portion 3.

When the carriage 11 reaches the retracted position (see FIG. 1A), the control device 2 (see FIG. 1C) causes the up-down moving mechanism 25 (see FIG. 1C) to raise the holder 5 of each capping mechanism 20. At this time, the up-down moving mechanism 25 raises the holder 5 in a state in which the front side of the holder 5 in the sub-scanning direction Y is located lower than the back side (see FIG. 7A).

Thus, the cap portion 3 supported by the holder 5 is raised in an inclined state, and the upper end 31*a* on the back side in the sub-scanning direction Y of the cap portion 3 is first brought into contact with the nozzle surface 120 (see FIG. 7B).

Subsequently, the control device 2 causes the up-down moving mechanism 25 to raise the front side of the holder 5 in the sub-scanning direction Y and displace the upper end 31*a* on the front side of the cap portion 3 in the sub-scanning direction Y in a direction of approaching the nozzle surface 120 (see FIG. 7B), and ultimately brings the annular region Rn on the upper end 31*a* side of the cap portion 3 into pressure contact with the nozzle surface 120 over the entire surface (see FIG. 7C). This is to enhance the sealing property as compared with the case where the upper end 31*a* on the front side and the back side in the sub-scanning direction Y are simultaneously brought into contact with the nozzle surface 120.

As a result, spaces Sa and Sb sealed by the cap portion 3 are formed between the cap portion 3 and the nozzle surface 120. In this state, the control device 2 drives a depressurizing mechanism (not shown) to discharge the air in the spaces Sa and Sb from the discharge port 502 and generate a negative pressure in the spaces Sa and Sb. Then, for example, a flushing operation is performed in a state where a negative pressure is generated in the spaces Sa and Sb (see FIG. 7C).

Then, after the ejection of the ink in the flushing operation is finished, the inside of the spaces Sa and Sb is kept at a negative pressure, so that the ink remaining in each nozzle hole 124 is suctioned toward the space Sa side. Here, the ink Ik suctioned into the space Sa collides with the filter 4. Since the filter 4 is formed of a resin material which does not allow ink to pass therethrough, the ink Ik adheres to the upper surface of the filter 4.

As described above, the guide groove 41 along the sub-scanning direction Y is formed on the upper surface of the filter 4, and the width Wa, the interval Wb, and the depth We of the guide groove 41 are set so as to exert the lotus effect. Therefore, the ink Ik that adhered to the filter 4 has low wettability with the filter 4, and hence ink droplets form. As described above, since the front side of the filter 4 in the sub-scanning direction Y is located lower than the back side, the ink droplet moves on the filter 4 by its own weight toward the front side in the sub-scanning direction Y (short side part 402) side.

Then, the communication holes 42 and 42 are provided in the short side part 402 of the filter 4, and an opening communicating the space Sa and the space Sb is formed by the communication holes 42 and 42 between the short side part 311 of the cap portion 3 and the filter 4.

Therefore, the ink that reached the short side part 402 of the filter 4 is suctioned into the space Sb on the lower side of the filter 4 from the portion of the communication holes 42 and 42, and then discharged from the discharge port 502 to the discharge pipe (not shown) attached with a pump.

This makes it possible to suitably prevent the ink Ik suctioned from the nozzle hole 124 from foaming in the space Sa and adhering to the nozzle surface 120. In such a case, when the foamed ink adheres to the nozzle surface 120, the meniscus (see FIG. 8A, enlarged view) in the nozzle hole 124 of the ink head 12 breaks, but in the present embodiment, the foamed ink is less likely to adhere to the nozzle surface 120 as the filter 4 is provided. Therefore, occurrence of a situation where the meniscus in the nozzle hole 124 of the ink head 12 breaks can be suitably prevented.

Even if the ink flowing backward from the discharge pipe side flows into the space Sb from the discharge port 502 during the flushing operation, the cap portion 3 can suitably prevent the ink flowing backward from directly adhering to the nozzle surface 120 as communication holes 42 and 42 are provided in a blank region Rx deviated from immediately below the nozzle hole 124 (see FIG. 8A).

Furthermore, when the capping mechanism 20 is lowered after the flushing operation is terminated, ink droplets sometimes adhere to the tapered surface 32 on the upper end 31*a* side of the cap portion 3. As described above, the slit 321 is provided on the tapered surface 32 and the lotus effect is exerted by the slit 321, and hence the wettability of the ink that adhered to the tapered surface 32 and the ink mist with respect to the tapered surface 32 is lowered thus forming droplets. Thus, the formed droplets do not stay on the tapered surface 32 but move toward the lower side on the bottom wall portion 30 side along the tapered surface 32.

When the wettability of the tapered surface 32 is low, the ink that adhered to the annular wall 31 may sometimes solidify as is. When the solidification of the ink occurs in the vicinity of the upper end 31*a* of the annular wall 31, the annular wall 31 of the cap portion 3 is elastically pressure contacted to the nozzle surface 120 without a clearance, and thus a closed space cannot be formed between the cap portion 3 and the nozzle surface 120. The occurrence of such an event can be suitably prevented by providing the slit 321 on the tapered surface 32.

As described above, the inkjet printing device 1 according to the present embodiment has the following configuration. (1) The inkjet printing device 1 includes the ink head 12 in which the nozzle hole 124 is opened in the nozzle surface 120 (opposing surface) facing the recording medium 10, the capping mechanism 20 that brings the cap portion 3 made of an elastic material such as rubber into contact with the nozzle surface 120 to cover a region where the nozzle hole 124 opens in the nozzle surface 120, and the carriage 11 provided so as to be movable in the main scanning direction X orthogonal to the conveying direction (sub-scanning direction Y) of the recording medium 10 and in which a plurality of ink heads 12 are arranged in the main scanning direction X. The inkjet printing device 1 is an inkjet printing device that causes the ink ejected from the nozzle hole 124 to land on the recording medium 10 while moving the carriage 11 in the main scanning direction X to print on the recording medium 10. When the ink head 12 is disposed at the standby position (predetermined position) set within the movement range of the carriage 11, the capping mechanism 20 brings the cap portion 3 made of an elastic material such as rubber into contact with the nozzle surface 120. At the inner periphery of the annular wall 31, a plurality of slits 321 directed toward the bottom wall portion 30 are provided in the peripheral direction, preferably, over substantially the entire periphery.

With such a configuration, a non-contact region due to the slit 321 is formed between the annular wall 31 and the ink droplet. The surface tension of the ink droplet is lowered, and the contact angle of the ink droplet is increased by forming the non-contact region. As a result, the ink droplets do not stay on the annular wall 31 but move toward the bottom wall portion 30 located on the lower side in the direction of gravity. Thus, the ink droplets can be suitably prevented from remaining on the annular wall 31 due to the surface tension of the ink in the cap portion 3. Thus, the formation of a clearance when the cap portion 3 is pressed against the nozzle surface 120 (lower surface) of the ink head 12 due to the residual ink droplets can be suitably prevented.

The inkjet printing device 1 according to the present embodiment has the following configuration. (2) The annular wall 31 includes a vertical portion (region where tapered surface 32 is provided in vertical line VL; see FIG. 5B) disposed in a direction along the vertical line direction with the installation state of the inkjet printing device 1 as a reference when the annular wall 31 is brought into contact with the nozzle surface 120, and a contact portion (region on bottom wall portion 30 side when seen from the region where tapered surface 32 is provided in annular wall 31) that makes contact with the nozzle surface 120 (opposing surface). At the contact portion of the annular wall 31, the tapered surface 32 is provided on the upper end 31*a* side in contact with the nozzle surface 120 in a direction in which the opening diameters W1 and W2 of the space surrounded by the annular wall 31 increase toward the upper end 31*a*. In the annular wall 31, at least the slit 321 is provided in the region of the tapered surface 32. The ink that adhered to the tapered surface 32 is guided to the inner peripheral side of the annular wall 31 (vertical portion) by the slit 321.

Since the annular wall 31 is disposed in the direction along the vertical line direction with the installation state of the inkjet printing device 1 as the reference, the ink that adhered to the inner periphery of the annular wall 31 can quickly move in a direction away from the nozzle surface 120. The tapered surface 32 is provided so as to be inclined by a predetermined angle with respect to the vertical line. Therefore, the ink that adhered to the tapered surface 32 is less likely to move than the ink that adhered to the inner periphery of the annular wall 31. According to the configuration described above, the slit 321 provided on the tapered surface 32 facilitates the movement of the ink droplet that adhered to the tapered surface 32 toward the bottom wall portion 30 side so that the ink droplets are less likely to remain on the upper end 31*a* side of the annular wall 31 that comes into contact with the nozzle surface 120 in the annular wall 31.

The inkjet printing device 1 according to the present embodiment has the following configuration. (2) Each of the slits 321 in the annular wall 31 is linearly extended in a direction of separating from the nozzle surface 120 from the position spaced apart from the upper end 31*a* (end) in contact with the nozzle surface 120, more specifically, the position spaced apart by a predetermined width Wx (e.g., 0.5 mm) toward the inner peripheral side of the annular wall 31 from the upper end 31*a*. On the upper end 31*a* side of the annular wall 31, an annular region Rn having a predetermined width Wx is formed.

Since the slit 321 is not provided at the upper end 31*a* in contact with the nozzle surface 120, lowering in rigidity on the upper end 31*a* side due to the provision of the slit 321 can be prevented. When the rigidity strength of the upper end 31*a* lowers, distortion or the like occurs on the upper end 31*a* side of the annular wall 31 when the cap portion 3 is brought into contact with the nozzle surface 120, so that a clearance is generated between the upper end 31*a* of the annular wall 31 and the nozzle surface 120. In such a case, ink sometimes scatters to the outside of the cap portion 3 from the generated clearance. According to the above configuration, the upper end 31*a* of the annular wall 31 can be brought into contact with the nozzle surface 120 without a clearance, and the closed spaces Sa and Sb can be reliably formed between the cap portion 3 and the nozzle surface 120, so that scattering of ink can be suitably prevented.

The inkjet printing device 1 according to the present embodiment has the following configuration. (4) The cap portion 3 has a bottom wall portion 30 (bottom portion) disposed with a space between the cap portion 3 and the nozzle surface 120. The bottom wall portion 30 seals the opening of the annular wall 31 to make the cap portion 3 into a bottomed tubular shape. In the annular wall 31, the filter 4 made of resin is disposed so as to be internally fitted to the bottom wall portion 30 side of the tapered surface 32. The slit 321 is provided in a portion of the tapered surface 32. In the bottom wall portion 30, an ink discharge hole 302 (discharge port) is opened.

When the slit 321 is formed to the bottom wall portion 30, a clearance caused by the slit 321 is formed between the outer periphery of the filter 4 and the inner periphery of the annular wall 31. Thus, when the ink flows backward from the discharge hole 302 side, the ink flowing backward may adhere to the nozzle surface 120 through the clearance. In such a case, the ink adhering to the nozzle surface 120 may be solidified, resulting in clogging of the nozzle hole 124 in some cases. According to the configuration described above, the ink flowing backward can be suitably prevented from directly adhering to the nozzle surface 120, so that the occurrence of such a situation can be suitably prevented.

The inkjet printing device 1 according to the present embodiment has the following configuration. (5) In the nozzle surface 120, a plurality of nozzle rows 125 are disposed at intervals in the main scanning direction X, the nozzle row being formed by arranging a plurality of nozzle holes 124 in the conveying direction (sub-scanning direction Y) of the recording medium 10. The length of the bottom wall portion 30 in the sub-scanning direction Y is longer than the length of the nozzle row 125 in the sub-scanning direction Y. One side of the bottom wall portion 30 in the sub-scanning direction Y is disposed at a position deviated from immediately below the nozzle row 125 in the sub-scanning direction Y when the cap portion 3 is brought into contact with the nozzle surface 120. In the filter 4, the communication hole 42 for communicating the bottom wall portion 30 side and the nozzle surface 120 side sandwiching the filter 4 is provided in a region deviated from immediately below the nozzle row 125. The discharge hole 302 of the cap portion 3 is provided at a position offset from one side to the other side in the sub-scanning direction Y, and the position of the communication hole 42 and the position of the discharge hole 302 are shifted in position in the sub-scanning direction Y.

Since the communication hole 42 is provided in a region (blank region Rx) deviated from immediately below the nozzle row 125, the ink flowing backward from the discharging hole 302 can be suitably prevented from rapidly flowing into the communication hole 42. Furthermore, even when the ink flowing backward passes through the communication hole 42, the ink right after passing through the communication hole can be suitably prevented from directly adhering to the nozzle surface 120.

The inkjet printing device 1 according to the present embodiment has the following configuration. (6) The thickness of the filter 4 becomes thicker from one side to the other side in the sub-scanning direction Y. A plurality of guide grooves 41 along the sub-scanning direction Y are provided at intervals in the main scanning direction X on the upper surface 405 on the nozzle surface 120 side of the filter 4.

With such a configuration, when negative pressure is generated in the spaces Sa and Sb between the nozzle surface 120 and the cap portion 3 to suction the ink in the nozzle hole 124 toward the spaces Sa and Sb, the ink suctioned from the nozzle hole 124 Is rapidly guided along the guide groove 41 to a region deviated from immediately below the nozzle row 125. In addition, at the time of the flushing operation, the ink ejected from the nozzle hole 124 is also rapidly guided to a region deviated from immediately below the nozzle row 125. Even when the ink suctioned from the nozzle hole 124 or the ink discharged from the nozzle hole 124 generates bubbles when colliding with the filter 4, the ink can be rapidly guided to the region deviated from immediately below the nozzle row 125 and hence the occurrence of a situation of adhering to the nozzle surface 120 can be suitably prevented.

Furthermore, even when bubbles are generated in the ink due to the pressure difference between the space Sa on one side and the space Sb on the other side sandwiching the filter 4, the adhering of the foamed ink to the nozzle surface 120 can be suppressed by interposing the filter 4.

The present disclosure of the present application is not limited to the mode of the above-described embodiment, and can be appropriately changed within the scope of the technical idea of the present disclosure of the present application.

What is claimed is:

1. An inkjet printing device, comprising:

an ink head, having a nozzle hole opened on an opposing surface facing a recording medium; and a capping mechanism that brings a cap portion made of an elastic material into contact with the opposing surface to cover a region where the nozzle hole opens in the opposing surface, wherein the cap portion comprises: an annular wall that surrounds the region where the nozzle hole opens in the opposing surface, and an inner periphery of the annular wall is provided with a tapered surface that is inclined in a direction in which an opening diameter of a space surrounded by the annular wall becomes wider toward an upper end of the annular wall, and a plurality of slits extending from an inner side to an outer side of the annular wall is provided in the tapered surface in a peripheral direction on the inner periphery of the annular wall.

2. The inkjet printing device according to claim 1, wherein the annular wall comprises:

a vertical portion, disposed in a direction along a vertical line direction when the annular wall is brought into contact with the opposing surface; and a contact portion that comes into contact with the opposing surface, wherein the contact portion comprises: the tapered surface at a side of an end that comes into contact with the opposing surface in the direction in which the opening diameter of the annular wall increases toward the end, and in the annular wall, the plurality of slits is provided at least in a region of the tapered surface, and an ink that adhered to the tapered surface is guided to an inner peripheral side of the vertical portion by the plurality of slits.

3. The inkjet printing device according to claim 2, wherein each of the plurality of slits in the annular wall extends from a position spaced apart from an end of the annular wall that comes into contact with the opposing surface.

4. The inkjet printing device according to claim 3, wherein the cap portion has a bottom portion disposed with an interval from the opposing surface, in the annular wall, a filter is disposed so as to be internally fitted to a side of the bottom portion relative to the tapered surface, the plurality of slits is provided at a portion of the tapered surface, and an ink discharge port is formed in the bottom portion.

5. The inkjet printing device according to claim 4, wherein a nozzle row configured by arranging a plurality of the nozzle holes in a sub-scanning direction, which is a conveying direction of the recording medium, is provided on the opposing surface, a length of the bottom portion in the sub-scanning direction is longer than a length of the nozzle row in the sub-scanning direction, one side of the bottom portion in the sub-scanning direction is disposed at a position deviated from immediately below the nozzle row, when the cap portion is brought into contact with the opposing surface, in the filter, a communication hole for communicating the side of the bottom portion and a side of the opposing surface sandwiching the filter is provided in a region deviated from immediately below the nozzle row, and the communication hole and the ink discharge port are provided so as to be shifted in position in the sub-scanning direction.

6. The inkjet printing device according to claim 5, wherein a thickness of the filter in a direction orthogonal to the bottom portion becomes thicker from one side to the other side in the sub-scanning direction, and a plurality of guide grooves along the sub-scanning direction are provided on a surface of the filter on the side of the opposing surface.

7. The inkjet printing device according to claim 2, wherein the cap portion has a bottom portion disposed with an interval from the opposing surface, in the annular wall, a filter is disposed so as to be internally fitted to a side of the bottom portion relative to the tapered surface, the plurality of slits is provided at a portion of the tapered surface, and an ink discharge port is formed in the bottom portion.

8. The inkjet printing device according to claim 7, wherein a nozzle row configured by arranging a plurality of the nozzle holes in a sub-scanning direction, which is a conveying direction of the recording medium, is provided on the opposing surface, a length of the bottom portion in the sub-scanning direction is longer than a length of the nozzle row in the sub-scanning direction, one side of the bottom portion in the sub-scanning direction is disposed at a position deviated from immediately below the nozzle row, when the cap portion is brought into contact with the opposing surface, in the filter, a communication hole for communicating the side of the bottom portion and a side of the opposing surface sandwiching the filter is provided in a region deviated from immediately below the nozzle row, and the communication hole and the ink discharge port are provided so as to be shifted in position in the sub-scanning direction.

9. The inkjet printing device according to claim 8, wherein a thickness of the filter in a direction orthogonal to the bottom portion becomes thicker from one side to the other side in the sub-scanning direction, and a plurality of guide grooves along the sub-scanning direction are provided on a surface of the filter on the side of the opposing surface.

* * * * *